US010527989B2

(12) United States Patent
Taki

(10) Patent No.: US 10,527,989 B2
(45) Date of Patent: Jan. 7, 2020

(54) IMAGE FORMING APPARATUS

(71) Applicant: KYOCERA Document Solutions Inc., Osaka (JP)

(72) Inventor: Seiji Taki, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/328,749

(22) PCT Filed: May 25, 2018

(86) PCT No.: PCT/JP2018/020156
§ 371 (c)(1),
(2) Date: Feb. 27, 2019

(87) PCT Pub. No.: WO2018/221408
PCT Pub. Date: Dec. 6, 2018

(65) Prior Publication Data

US 2019/0204771 A1 Jul. 4, 2019

(30) Foreign Application Priority Data

May 30, 2017 (JP) ..... 2017-107034

(51) Int. Cl.
*G03G 15/00* (2006.01)
*G03G 15/043* (2006.01)

(52) U.S. Cl.
CPC ..... *G03G 15/5025* (2013.01); *G03G 15/043* (2013.01); *G03G 15/5041* (2013.01)

(58) Field of Classification Search
CPC ..... G03G 15/5025; G03G 15/5041; G03G 15/043
See application file for complete search history.

(56) References Cited

U.S. PATENT DOCUMENTS 5,784,667 A 7/1998 Mestha et al.
2012/0200868 A1 8/2012 Ikeda et al.
(Continued)

FOREIGN PATENT DOCUMENTS

JP 2008-026551 2/2008
JP 2010-134160 6/2010
(Continued)

OTHER PUBLICATIONS

International Search Report dated Jul. 17, 2018 in International (PCT) Application No. PCT/JP2018/0120156.

*Primary Examiner* — Sandra Brase
(74) *Attorney, Agent, or Firm* — Wenderoth, Lind & Ponack, L.L.P.

(57) ABSTRACT

A density correction unit calculates a density change rate to a change in an exposure amount as a first density change rate based on a difference between a density of a part of reference patch images, in which a position in a main scanning direction is identical to a position of a first patch image. As for a second patch image, the density correction unit similarly calculates a second density change rate. A light amount when forming the first patch image is smaller than a reference light amount. A light amount when forming the second patch image is larger than the reference light amount. The density correction unit uses the first or the second density change rate based on whether a density of each position of the reference patch images in the main scanning direction higher or lower than a target density to correct the exposure amount.

2 Claims, 8 Drawing Sheets

(56) References Cited

U.S. PATENT DOCUMENTS

| | | | | |
|---|---|---|---|---|
| 2015/0002597 | A1* | 1/2015 | Shida | G03G 15/043<br>347/118 |
| 2016/0085194 | A1* | 3/2016 | Shirafuji | G03G 15/5025<br>399/49 |
| 2018/0059569 | A1* | 3/2018 | Matsuura | G03G 15/5041 |

FOREIGN PATENT DOCUMENTS

| | | |
|---|---|---|
| JP | 2010-134178 | 6/2010 |
| JP | 2012-163866 | 8/2012 |
| JP | 2014-215504 | 11/2014 |
| JP | 2016-206446 | 12/2016 |
| JP | 2016-208151 | 12/2016 |

* cited by examiner

IMAGE FORMING APPARATUS

TECHNICAL FIELD

The present invention relates to an image forming apparatus.

BACKGROUND ART

In general, in an electrophotographic image forming apparatus, an exposure device exposes a surface of a photoreceptor to form an electrostatic latent image, a developing device develops the formed electrostatic latent image to form a toner image, and the formed toner image is transferred to a recording medium, so that an image is formed.

In the photoreceptor on which the electrostatic latent image is formed, irregularity of charging characteristics or sensitivity characteristics exists in an axial direction of a drum surface due to factors on manufacturing. Furthermore, when the toner image is formed by developing the electrostatic latent image, there is a problem that density irregularity occurs in a main scanning direction (a drum shaft direction) due to an influence of variance of a gap with a developer carrier that supplies toner to the photoreceptor, variance of a light amount of an exposure means in the main scanning direction, and the like.

In order to solve such a problem, in an image forming apparatus disclosed in Patent Literature 1, a belt-like patch image extending in the whole main scanning direction of an image forming area is printed, and an exposure amount is corrected at each position in the main scanning direction such that a density at each position of the printed patch image in the main scanning direction reaches a target density. When the exposure amount is corrected, it is necessary to calculate a density change rate to the exposure amount. In this regard, in the image forming apparatus disclosed in Patent Literature 1, two patch images having different exposure amounts are printed and densities of both images are compared with each other at each position in the main scanning direction, so that the density change rate to the exposure amount is calculated (see paragraph 0060 of Patent Literature 1).

CITATION LIST

Patent Literature

Patent Literature 1: Japanese Unexamined Patent Application Publication No. 2010-134160

SUMMARY OF INVENTION

Technical Problem

However, in the related image forming apparatus disclosed in Patent Literature 1, since it is necessary to print the two patch images on recording sheets different from each other, there is a problem that much time is required to print the patch images. Furthermore, change characteristics of density to a change in an exposure amount generally show non-linear characteristics, but in the image forming apparatus disclosed in Patent Literature 1, it is possible to calculate a change amount of density only between two exposure amounts, that is, an exposure amount when a first patch image is printed and an exposure amount when a second patch image is printed. Thus, it is not possible to sufficiently recognize change characteristics of the density to a change in the exposure amount. As a consequence, there is a problem that density correction precision (exposure amount correction precision) at each position of the patch image in the main scanning direction is reduced.

The present invention has been made to solve the aforementioned problems, and an object of the present invention is to improve density correction precision of a printed image while shortening time required for printing a density correction image.

Solution to Problem

An image forming apparatus according to the present invention has an exposure device that forms an electrostatic latent image by exposing a surface of a photoreceptor with a preset exposure amount and a developing device that forms a toner image by developing the electrostatic latent image formed by the exposure device, and includes an image forming unit that forms an image by transferring the toner image developed by the developing device to a recording medium, an image forming control unit that controls the image forming unit to form a patch image on the recording medium, and a density correction unit that corrects a density of the toner image at each position in a main scanning direction to reach a target density based on the patch image formed by the image forming control unit.

The image forming control unit is configured to form belt-like reference patch images extending over about a whole in the main scanning direction of an image forming area of the recording medium in a state in which the exposure amount of the exposure device has been set as a reference light amount, and to form a first patch image and a second patch image at positions, at which positions of the first patch image and the second patch image in a sub-scanning direction are different from positions of the reference patch images, arranged side by side by employing the exposure amount of the exposure device as a first light amount and a second light amount, and the image forming apparatus further includes: an image reading unit that reads densities of the reference patch images and the first and second patch images formed on the recording medium, wherein the first light amount is smaller than the reference light amount and the second light amount is larger than the reference light amount, and the density correction unit is configured to calculate a density change rate to a change in the exposure amount as a first density change rate based on a difference between a density of a part of the reference patch images, in which a position in the main scanning direction is identical to a position of the first patch image, and a density of the first patch image, to calculate a density change rate to a change in an exposure amount as a second density change rate based on a difference between a density of a part of the reference patch images, in which a position in the main scanning direction is identical to a position of the second patch image, and a density of the second patch image, to determine whether a density of each position of the reference patch images in the main scanning direction is higher than a target density, to correct a setting value of the exposure amount by using the first density change rate when it is determined that the density is higher than the target density, and to correct the setting value of the exposure amount by using the second density change rate when it is determined that the density is lower than the target density, thereby performing density correction.

Advantageous Effects of Invention

According to the present invention, it is possible improve density correction precision of a printed image while shortening time required for printing a patch image.

DESCRIPTION OF EMBODIMENTS

Hereinafter, embodiments of the present invention will be described in detail on the basis of the drawings. It is noted that the present invention is not limited to the following embodiments.

Embodiment 1

Figure 1:
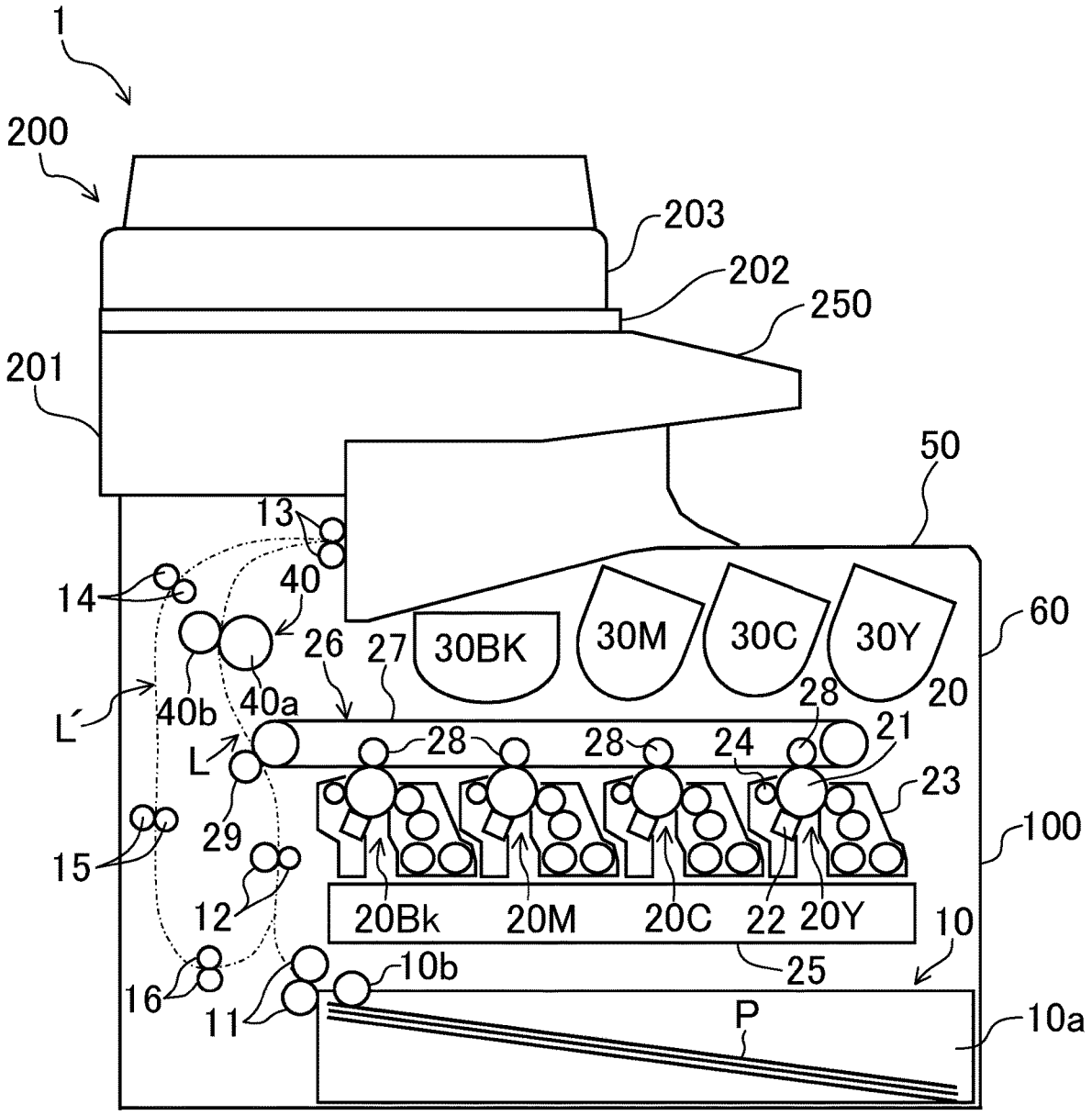
FIG. 1 is a schematic view illustrating an overall configuration of an image forming apparatus in an embodiment.

FIG. 1 illustrates a laser printer 1 (hereinafter, simply referred to as a printer) as an image forming apparatus in the present embodiment. The printer includes an image forming apparatus body 100, a scanner device 200 mounted above the image forming apparatus body 100, and an operation unit 250 operable by a user. In the following description, a front side and a rear side indicate a front side (a side at which the operation unit 250 is position) and a rear side of the printer 1, and a left side and a right side indicate a left side and a right side when the printer 1 is viewed from the front side.

The image forming apparatus body 100 has a box-like casing 60. An upper surface of the casing 60 is covered by the scanner device 200 so as to be openable/closable. Furthermore, a front part of the casing 60 is closed by a sheet discharging tray 50. The sheet discharging tray 50 is supported to the casing 60 such that its front end side pivots in an up and down direction.

The casing 60 receives a sheet feeding unit 10, an image forming unit 20, and a fixing unit 40 therein. On a sheet conveyance path L from the sheet feeding unit 10 to the sheet discharging tray 50, a plurality of conveying roller pairs 11 to 13 are disposed to convey a recording sheet (a recording medium) P while interposing the recording sheet P therebetween. Furthermore, an inversion conveyance path L' is provided to be branched from a downstream side of the sheet conveyance path L and be joined at an upstream side thereof. On the inversion conveyance path L', conveying roller pairs 14 to 16 are disposed.

The sheet feeding unit 10 is disposed at a lower part of the casing 60. The sheet feeding unit 10 has a sheet feeding cassette 10*a* that receives the recording sheet P having a sheet shape and a pick-up roller 10*b* that takes out the recording sheet P in the sheet feeding cassette 10*a* and sends the taken-out recording sheet P out of the cassette. The recording sheet P sent out of the cassette from the sheet feeding cassette 10*a* is supplied to the image forming unit 20 via the conveying roller pair 11. In the image forming unit 20, image forming units 20BK, 20M, 20C, and 20Y are disposed in a row to form toner images corresponding to each color of black, magenta, cyan, and yellow. Each of the image forming units 20BK, 20M, 20C, and 20Y includes a photosensitive drum 21, a charging device 22, a developing device 23, and a cleaning device 24. Below the image forming units 20BK, 20M, 20C, and 20Y, an exposure device 25 is disposed to irradiate laser light to the surface of each photosensitive drum 21. Furthermore, above, the image forming units 20BK, 20M, 20C, and 20Y, an intermediate transfer unit 26 is disposed. The intermediate transfer unit 26 is provided with an intermediate transfer belt 27 that runs in contact with each photosensitive drum 21. Inside the intermediate transfer belt 27, a primary transfer roller 28 is disposed to interpose the intermediate transfer belt 27 between the primary transfer roller 28 and each photosensitive drum 21. Furthermore, at a downstream side of the image forming unit 20BK, a secondary transfer roller 29 is provided in contact with the surface of the intermediate transfer belt 27. Above the intermediate transfer unit 26, toner containers 30BK, 30M, 30C, and 30Y are disposed to store toner of each color, which is to be replenished to the developing devices 23 of the image forming units 20BK, 20M, 20C, and 20Y.

In the image forming unit 20, an electrostatic latent image is formed by irradiating laser light based on predetermined image data (for example, document image data read by the scanner device 200) to the surfaces of the photosensitive drums 21 from the exposure device 25, and the formed electrostatic latent image is developed by the developing device 23, so that toner images of each color are formed. The toner images of each color formed on the surfaces of the photosensitive drums 21 are transferred onto the surface of the intermediate transfer belt 27 by the primary transfer roller 28 and are superposed thereon. Then, the toner images transferred onto the surface of the intermediate transfer belt 27 are transferred to the recording sheet P, which is supplied from the sheet feeding unit 10, by the secondary transfer roller 29. The recording sheet P after the transfer is supplied to the fixing unit 40. The fixing unit 40 pressurize the recording sheet P supplied from the image forming unit 20 between a fixing roller 40*a* and a pressure roller 40*b*, thereby fixing the toner images to the recording sheet P. Then, the recording sheet P with the toner images fixed by the fixing unit 40 is sent to a downstream by the two rollers 40*a* and 40*b*. The recording sheet P sent from the fixing unit 40 is discharged to the sheet discharging tray 50 via the plurality of conveying roller pairs 12 and 13. Furthermore, when the toner images are formed on both surfaces of the recording sheet P, the recording sheet P is switched back by the conveying roller pair 13 and is conveyed to the inversion conveyance path L'.

The scanner device 200 has a document reading unit 201, a document cover 202, and an automatic document feeder 203.

An upper surface of the document reading unit 201 forms a document placing surface on which a document is placed. The document placing surface is formed with an approximately rectangular opening (not illustrated), and a contact glass is fitted into the opening. The document cover 202 pivots up and down by employing its end edge as a fulcrum, thereby covering the upper surface of the document reading unit 201 so as to be openable/closable. The automatic document feeder 203 is provided on an upper surface of the document cover 202. The automatic document feeder 203 conveys bundle-like documents set in a sheet feeding tray (not illustrated) along a predetermined conveyance path one by one, and allows the document to pass through a predetermined image reading position on the contact glass. The document reading unit 201 receives a scanner unit that optically reads an image of a document placed on the contact glass or a document supplied onto the contact glass by the automatic document feeder 203. The scanner unit generates data of the read document image and transmits the data to a control unit 300 (see FIG. 2) to be described later.

Figure 2:
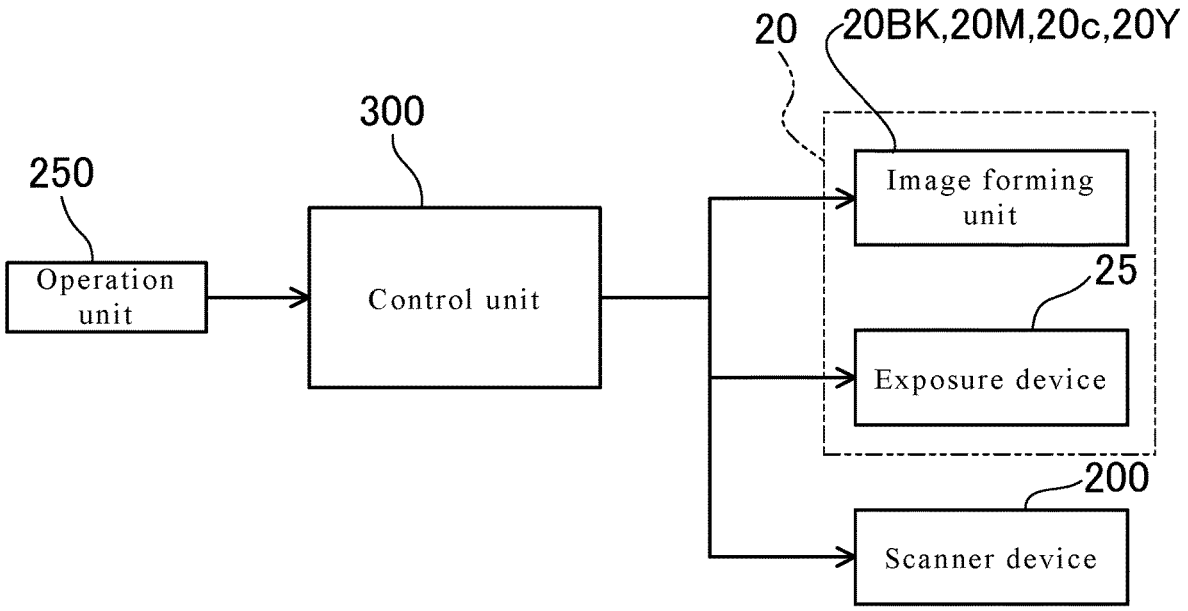
FIG. 2 is a block diagram illustrating a configuration of a control system of an image forming apparatus.

FIG. 2 is a block diagram illustrating a configuration of a control system of the printer 1. The control system includes the control unit 300. The control unit 300 includes a microcomputer having a CPU, a ROM, and a RAM. The image forming unit 20, the operation unit 250, and the scanner device 200 are connected to the control unit 300 via signal lines. The control unit 300 controls the image forming unit 20, the scanner device 200 and the like on the basis of an operation signal received from the operation unit 250, thereby performing a predetermined process. The control unit 300 constitutes an image forming control unit and a density correction unit of the present invention.

Meanwhile, in the photosensitive drum 21 with the formed electrostatic latent image, irregularity of charging characteristics or sensitivity characteristics exists in an axial direction of the drum surface due to factors on manufacturing. Furthermore, when the toner image is formed by developing the electrostatic latent image, there is a problem that density irregularity occurs in a printed image in the main scanning direction due to an influence of variance of a gap with a developer carrier that supplies toner to the photosensitive drum 21, variance of a light amount of the laser light in the main scanning direction, and the like.

In contrast, in the laser printer of the present embodiment, the control unit 300 performs density correction control at each position in the main scanning direction, thereby suppressing the occurrence of density irregularity in the main scanning direction. Each position in the main scanning direction, for example, may be a position corresponding to each pixel of image data generated by the document reading unit 201, or a position of each block including a plurality of pixels.

Figure 3:
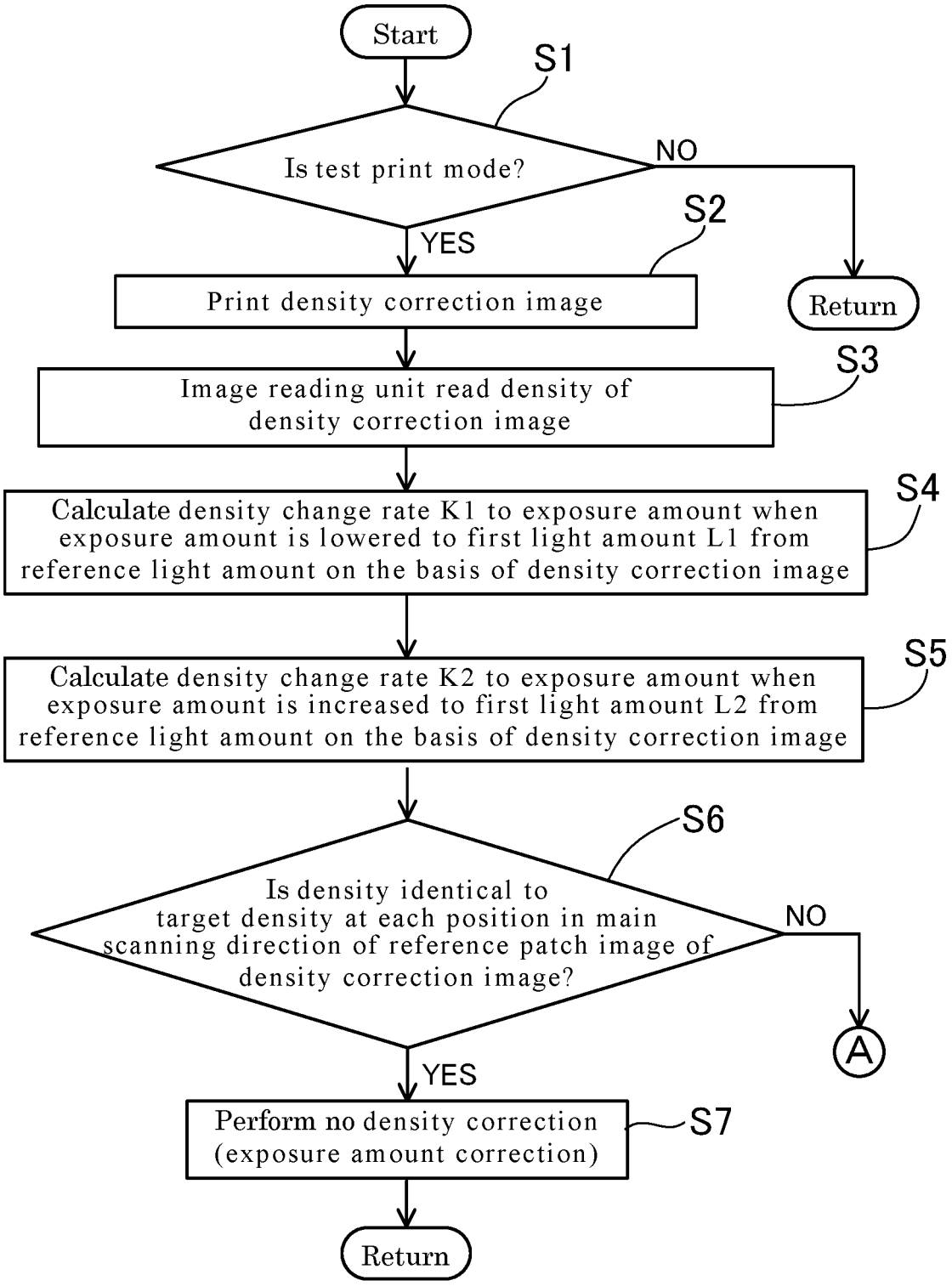
FIG. 3 is a flowchart illustrating a first half of density correction control performed by a control unit.
Figure 4:
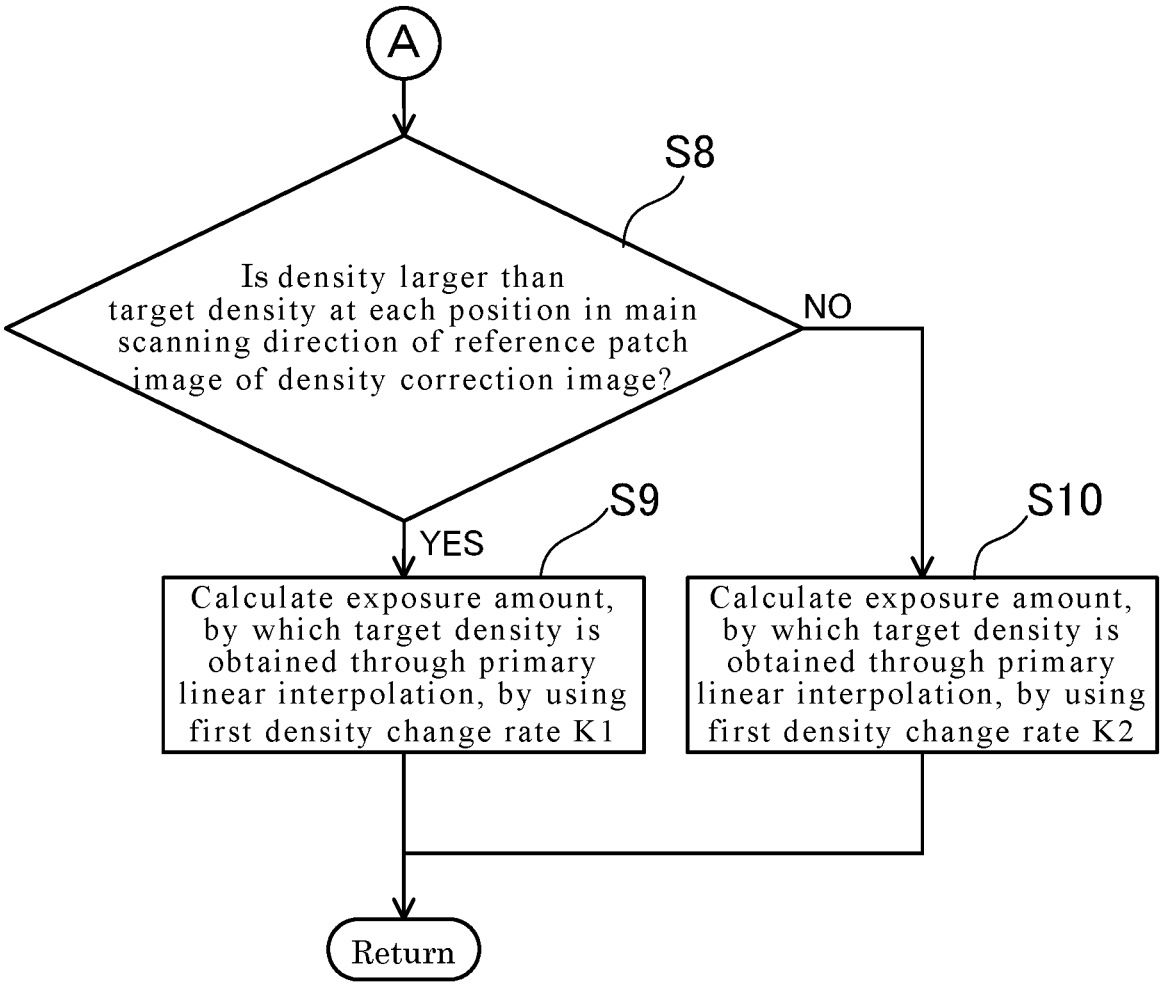
FIG. 4 is a flowchart illustrating a second half of density correction control performed by a control unit.

FIG. 3 and FIG. 4 are flowcharts illustrating content of the density correction control performed by the control unit 300.

In step S1, on the basis of the operation signal from the operation unit 250, the control unit 300 determines whether a current print mode of the printer 1 is a test print mode. When this determination is NO, the processing returns, and when this determination is YES, the control unit 300 proceeds to step S2.

In step S2, the control unit 300 prints a density correction image T (see FIG. 5) on one recording sheet P. The density correction image T includes reference patch images BK0, C0, M0, and Y0, first patch images BK1, C1, M1, and Y1, and second patch images BK2, C2, M2, and Y2, which are formed with respect to each color of black, cyan, magenta, and cyan. These patch images BK0 to BK2, C0 to C2, M0 to M2, and Y0 to Y2 may be solid images or halftone images.

The four reference patch images BK0, C0, M0, and Y0 extend in a belt shape over about the whole in the main scanning direction of the image forming area of the recording sheet P. The four reference patch images BK0, C0, M0, and Y0 are juxtaposed in this order in a sub-scanning direction.

The first patch images BK1, C1, M1, and Y1 and the second patch images BK2, C2, M2, and Y2 are formed at a row (that is, a different position in the sub-scanning direction) adjacent to the reference patch image Y0 (yellow) positioned at the farmost end of the four reference patch images BK0, C0, M0, and Y0. The first patch images BK1, C1, M1, and Y1 and the second patch images BK2, C2, M2, and Y2 are juxtaposed in the main scanning direction with a pair of one set for each color.

An exposure amount of the exposure device 25 when forming the reference patch images BK0, C0, M0, and Y0 is set to a reference light amount L0, the exposure amount of the exposure device 25 when forming the first patch images BK1, C1, M1, and Y1 is set to a first light amount L1 (for example, 0.8 times as small as the reference light amount) smaller than the reference light amount L0, and the exposure amount of the exposure device 25 when forming the second patch images BK2, C2, M2, and Y2 is set to a second light amount L2 (for example, 1.2 times as large as the reference light amount) larger than the reference light amount L0.

In step S3, the scanner device (an image reading unit) 200 reads the density of the density correction image T printed on the recording sheet P. It is sufficient if the reading of the density correction image T by the scanner device 200 is manually performed by a user. However, the density correction image T printed on the recording sheet P may be automatically read by a line sensor and the like provided on the conveyance path.

In step S4, on the basis of the density of the density correction image T read in step S3, a density change rate (hereinafter, referred to as a first density change rate) K1 when the exposure amount of the exposure device 25 is lowered to the first light amount L1 from the reference light amount L0 is calculated for each color. A detailed calculation procedure of the change rate K1 will be described later.

In step S5, on the basis of the density of the density correction image T read in step S3, a density change rate (hereinafter, referred to as a second density change rate) K2 when the exposure amount of the exposure device 25 is increased to the second light amount L2 from the reference light amount L0 is calculated for each color. A detailed calculation procedure of the change rate K2 will be described later.

In step S6, the control unit 300 determines whether the read density is identical to a target density at each position in the main scanning direction of the reference patch images BK0, C0, M0, and Y0 of the density correction image T read in step S3. When this determination is NO, the control unit 300 proceeds to step S8, and when this determination is YES, the control unit 300 proceeds to step S7.

In step S7, the processing returns without correcting the setting values of the exposure amount of the exposure device 25.

In step S8, which is performed when the determination of step S6 is NO, the control unit 300 determines whether the read density is larger than the target density at each position in the main scanning direction of the reference patch images BK0, C0, M0, and Y0 of the density correction image T read in step S3. When this determination is NO, the control unit 300 proceeds to step S10, and when this determination is YES, the control unit 300 proceeds to step S9.

In step S9, the control unit 300 calculates an exposure amount, by which the density at each position in the main scanning direction is identical to the target density, by using the first density change rate K1 calculated in step S4 through primary linear interpolation, and then the processing returns.

In step S10, the control unit 300 calculates an exposure amount, by which the density at each position in the main scanning direction is identical to the target density, by using the second density change rate K2 calculated in step S5 through the primary linear interpolation, and then the processing returns.

Next, with reference to FIG. 6 and FIG. 7, the calculation method of the density change rates K1 and K2 in steps S4 and S5 and the calculation method of the corrected exposure amounts in steps S9 and S10 will be described. Since these calculation methods are identical to each other for each color of black, cyan, magenta, and cyan, the following description will be given only for the magenta.

Figure 5:
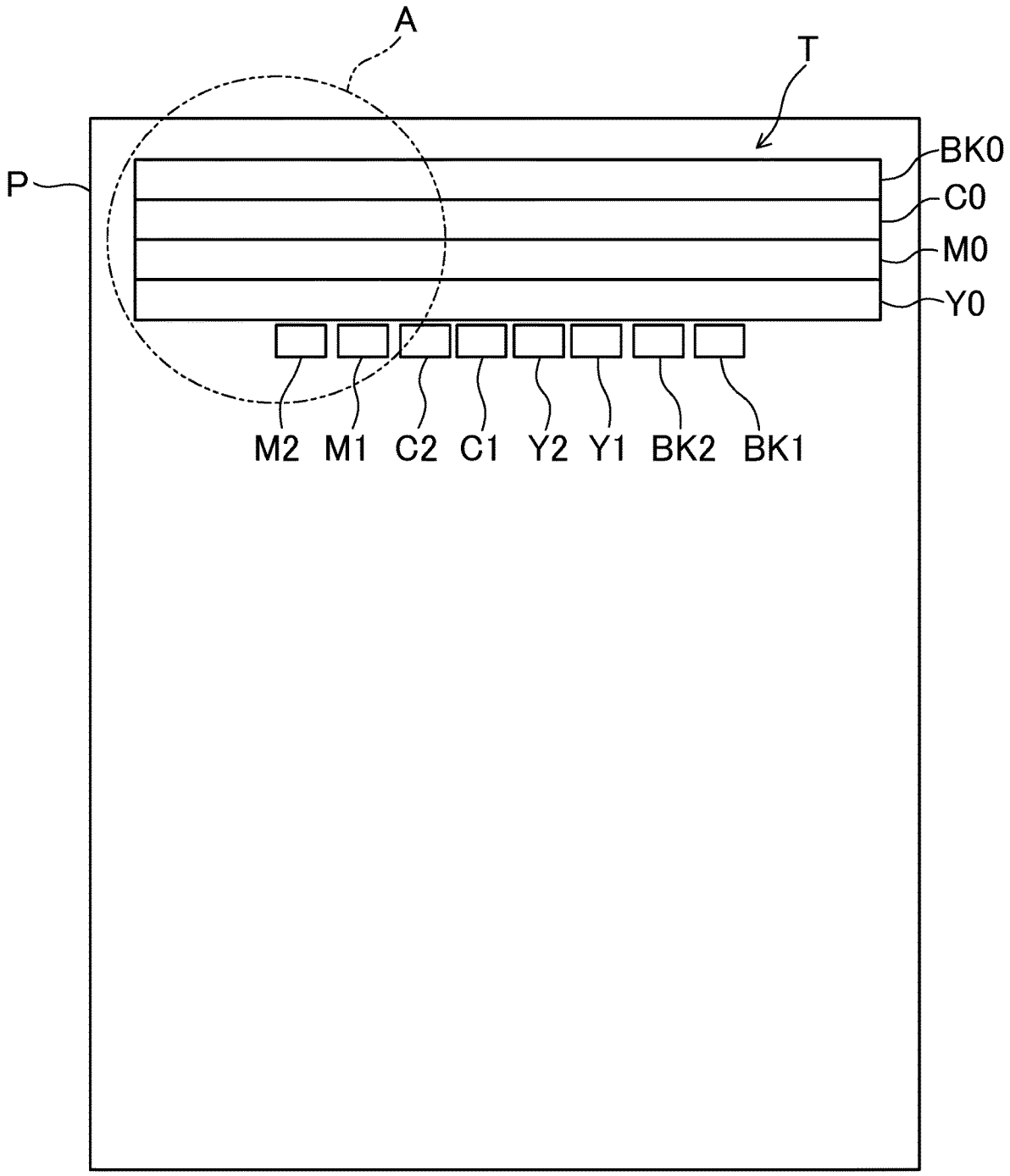
FIG. 5 is a schematic view illustrating an example of a density correction image.
Figure 6:
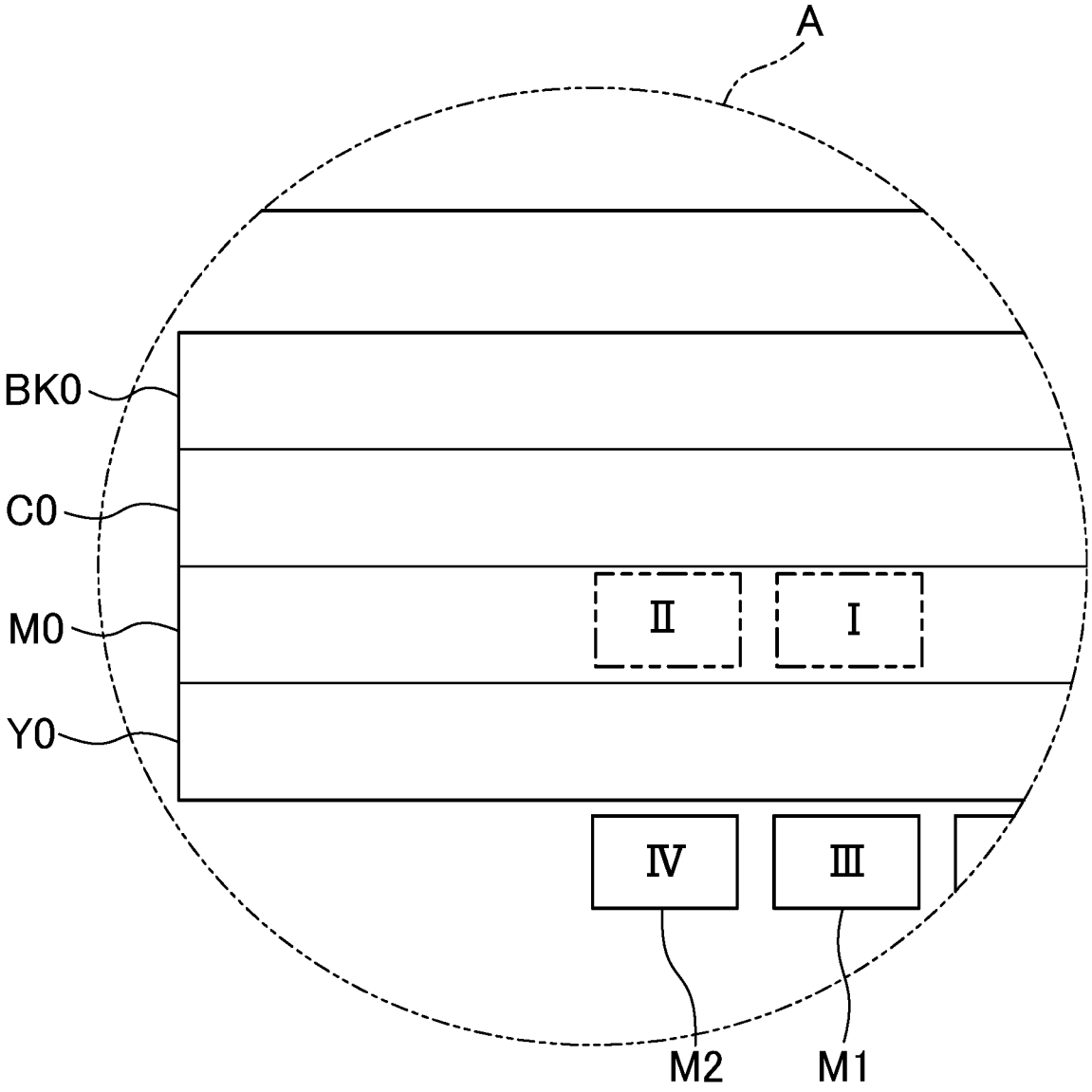
FIG. 6 is an enlarged view illustrating a part A of FIG. 5.
Figure 7:
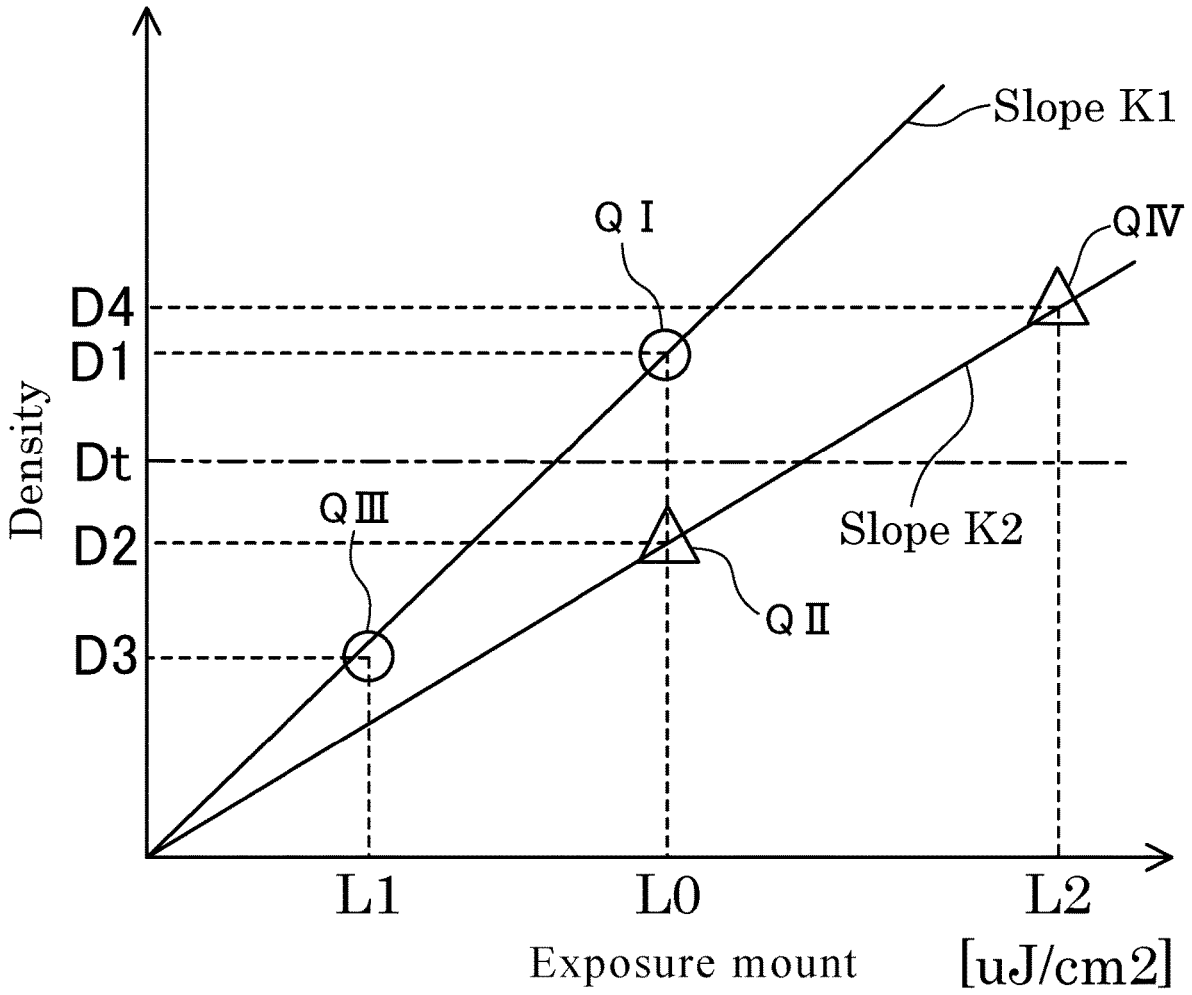
FIG. 7 is a graph for explaining a calculation method of a density change rate to an exposure amount.

FIG. 6 is an enlarged view illustrating a part of FIG. 5, and FIG. 7 is a graph in which a horizontal axis indicates an exposure amount, a vertical axis indicates density, and exposure amounts and densities of areas I to IV of FIG. 6 are plotted. The area I is an area where the position of the reference patch image M0 is identical to the position of the first patch image M1 (the area III) in the main scanning direction, and the area II is an area where the position of the reference patch image M0 is identical to the position of the second patch image M2 (the area IV) in the main scanning direction. The sizes of the area I and the area III are identical to each other and the sizes of the area II and the area IV are identical to each other.

In the graph of FIG. 7, the first density change rate K1 is a slope of a straight line connecting a point QI corresponding to the area I to a point QIII corresponding to the area III and is indicated by $K1=(D1-D3)/(L0-L1)$. In step S9 in which the density Di is larger than the target density Dt, when the current exposure amount is set as xi and the corrected exposure amount is set as Xi, $Xi=-1/K1\times(Di-Dt)+xi$.

In the graph of FIG. 7, the second density change rate K2 is a slope of a straight line connecting a point QIV corresponding to the area IV to a point QII corresponding to the area II and is indicated by $K2=(D4-D2)/(L2-L0)$. In step S10 in which the density Di is smaller than the target density Dt, when the current exposure amount is set as xi and the corrected exposure amount is set as Xi, $Xi=-1/K2\times(Di-Dt)+xi$.

As described above, on the basis of a difference between the density of a part of the reference patch images BK0, C0, M0, and Y0, in which its position in the main scanning direction is identical to that of the first patch image BK1, C1, M1, or Y1, and the density of the first patch image BK1, C1, M1, or Y1, the control unit 300 calculates the density change rate to a change in the exposure amount as the first density change rate K1 (step S4), and on the basis of a difference between the density of a part of the reference patch images BK0, C0, M0, and Y0, in which its position in the main scanning direction is identical to that of the second patch image BK2, C2, M2, or Y2, and the density of the second patch image BK2, C2, M2, or Y2, the control unit 300 calculates the density change rate to a change in the exposure amount as the second density change rate K2 (step S5). Then, the control unit 300 determines whether the density Di of each position of the reference patch images BK0, C0, M0, and Y0 in the main scanning direction is higher than the target density Dt (performs the determination of step S8). When it is determined that the density Di is higher than the target density Dt (YES in step S8), the control unit 300 corrects the setting value of the exposure amount by using the first density change rate K1 (step S9), and when it is determined that the density Di is lower than the target density Dt (NO in step S8), the control unit 300 corrects the setting value of the exposure amount by using the second density change rate K2 (step S10).

According to such a configuration, depending on whether the density Di at each position of the reference patch images BK0, C0, M0, and Y0 in the main scanning direction is higher or lower than the target density, the first density change rate K1 and the second density change rate K2 are properly used, so that it is possible to improve density correction precision.

Furthermore, the reference patch images BK0, C0, M0, and Y0, the first patch images BK1, C1, M1, and Y1, and the second patch images BK2, C2, M2, and Y2 are printed on one recording sheet P, so that it is possible to shorten time required for printing the patch images.

Modification Example

Figure 8:
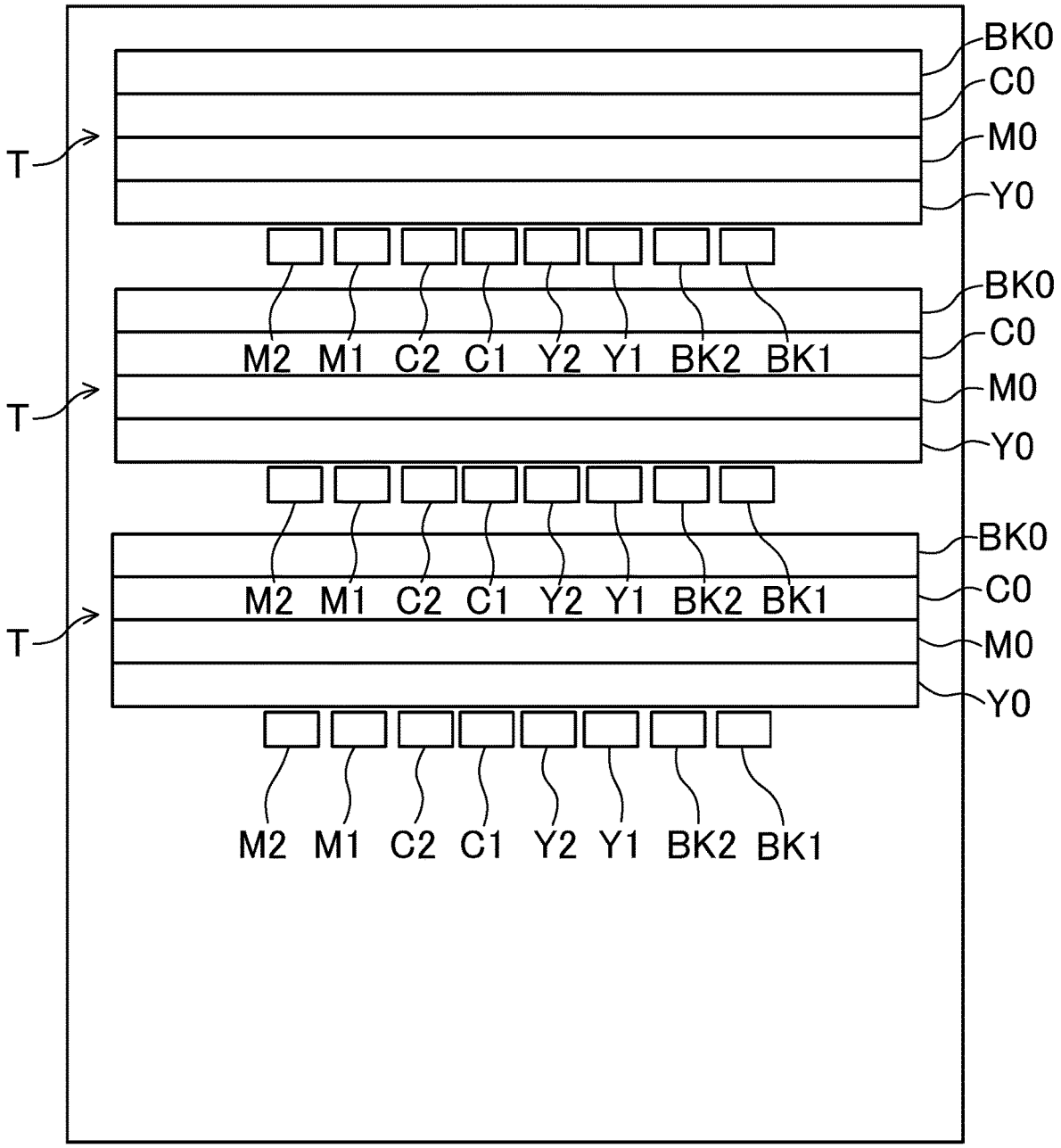
FIG. 8 is a view corresponding to FIG. 3, which illustrates a modification example.

FIG. 8 is a view corresponding to FIG. 5, which illustrates a modification example of the embodiment. In this modification example, a plurality of (three) density correction images T, which each include the reference patch images BK0, C0, M0, and Y0, the first patch images BK1, C1, M1, and Y1, and the second patch images BK2, C2, M2, and Y2, are formed in the sub-scanning direction. The control unit 300 performs density correction by using an exposure amount obtained by averaging the setting values of corrected exposure amounts Xi calculated in each of the three density correction images T by the number of the density correction images T (three in the present modification example).

According to such a configuration, it is possible to precisely correct density irregularity in the sub-scanning direction as well as density irregularity in the main scanning direction.

INDUSTRIAL APPLICABILITY

As described above, the present invention is available for an image forming apparatus.

The invention claimed is:

1. An image forming apparatus including an exposure device that forms an electrostatic latent image by exposing a surface of a photoreceptor with a preset exposure amount and a developing device that forms a toner image by developing the electrostatic latent image formed by the exposure device, comprising:

an image forming unit that forms an image by transferring the toner image developed by the developing device to a recording medium;

an image forming control unit that controls the image forming unit to form a patch image on the recording medium; and a density correction unit that corrects a density of the toner image at each position in a main scanning direction to reach a target density based on the patch image formed by the image forming control unit, wherein the image forming control unit is configured to form belt-like reference patch images extending over about a whole in the main scanning direction of an image forming area of the recording medium in a state in which the exposure amount of the exposure device has been set as a reference light amount, and to form a first patch image and a second patch image at positions, at which positions of the first patch image and the second patch image in a sub-scanning direction are different from positions of the reference patch images, arranged side by side by employing the exposure amount of the exposure device as a first light amount and a second light amount, and the image forming apparatus further comprises:

an image reading unit that reads densities of the reference patch images and the first and second patch images formed on the recording medium, wherein the first light amount is smaller than the reference light amount and the second light amount is larger than the reference light amount, and the density correction unit is configured to calculate a density change rate to a change in the exposure amount as a first density change rate based on a difference between a density of a part of the reference patch images, in which a position in the main scanning direction is identical to a position of the first patch image, and a density of the first patch image, to calculate a density change rate to a change in an exposure amount as a second density change rate based on a difference between a density of a part of the reference patch images, in which a position in the main scanning direction is identical to a position of the second patch image, and a density of the second patch image, to determine whether a density of each position of the reference patch images in the main scanning direction is higher than a target density, to correct a setting value of the exposure amount by using the first density change rate when it is determined that the density is higher than the target density, and to correct the setting value of the exposure amount by using the second density change rate when it is determined that the density is lower than the target density, thereby performing density correction.

2. The image forming apparatus of claim 1, wherein the image forming control unit is configured to print a plurality of density correction images, which each include the reference patch images, the first patch image, and the second patch images, arranged side by side in the sub-scanning direction, and the density correction unit is configured to perform the density correction by using an exposure amount obtained by averaging the setting value of the corrected exposure amount calculated in each of the density correction images by a number of the density correction images.

* * * * *